United States Patent [19]

Schmid

[11] 3,995,684

[45] Dec. 7, 1976

[54] APPARATUS FOR THE DIRECT COOLING OF A STRAND

[75] Inventor: Markus Schmid, Zurich, Switzerland

[73] Assignee: Concast AG, Zurich, Switzerland

[22] Filed: Mar. 14, 1975

[21] Appl. No.: 558,242

[30] Foreign Application Priority Data

Mar. 20, 1974 Switzerland ..... 3875/74

[52] U.S. Cl. ..... 164/283 S; 118/314; 118/315; 134/122 R; 134/181; 239/185; 266/65

[51] Int. Cl.[2] ..... B22D 11/124; B05B 3/18; C21D 1/62

[58] Field of Search ..... 164/46, 72, 113, 128, 164/267, 284, 297, 329, 283, 283 MS, 283 S; 425/103; 134/64 R, 64 P, 122 R, 122 P, 180, 181, 64, 172, 198; 239/391, 392, 393, 394, 185, 186, 536; 266/4 S, 6 S; 118/315, 314, 411, 412, 8

[56] References Cited

UNITED STATES PATENTS

| | | | |
|---|---|---|---|
| 2,995,173 | 8/1961 | Nawalanic | 118/315 X |
| 3,101,730 | 8/1963 | Harris | 134/181 X |
| 3,151,197 | 9/1964 | Schultz | 266/3 R X |
| 3,188,009 | 6/1965 | Miscovich | 239/394 X |
| 3,310,295 | 3/1967 | Haak | 266/4 S |
| 3,385,525 | 5/1968 | Jacobs | 239/394 |
| 3,402,695 | 9/1968 | Baker | 118/315 X |
| 3,428,023 | 2/1969 | Cox | 266/6 S X |
| 3,456,615 | 7/1969 | Zander | 118/8 X |
| 3,468,362 | 9/1969 | Burkhardt | 164/283 S X |
| 3,516,611 | 6/1970 | Piggott | 239/391 |
| 3,604,696 | 9/1971 | Coleman | 266/6 S |
| 3,738,629 | 6/1973 | Coleman | 134/122 X |
| 3,771,730 | 11/1973 | Nicoloff | 239/536 |
| 3,885,741 | 5/1975 | Wagener | 164/283 S X |

*Primary Examiner*—Francis S. Husar
*Assistant Examiner*—John S. Brown
*Attorney, Agent, or Firm*—Werner W. Kleeman

[57] ABSTRACT

An apparatus for the direct cooling of a strand, especially during the continuous casting of steel, incorporating strand guide segments equipped with spray nozzles for the application of a cooling agent to the strand. The spray nozzles are arranged at rotatable holders, each holder is equipped with at least two nozzles. A drive mechanism is provided for the stepwise or incremental rotation of such holders and there are provided infeed means for delivering the cooling agent to the spray nozzles.

5 Claims, 4 Drawing Figures

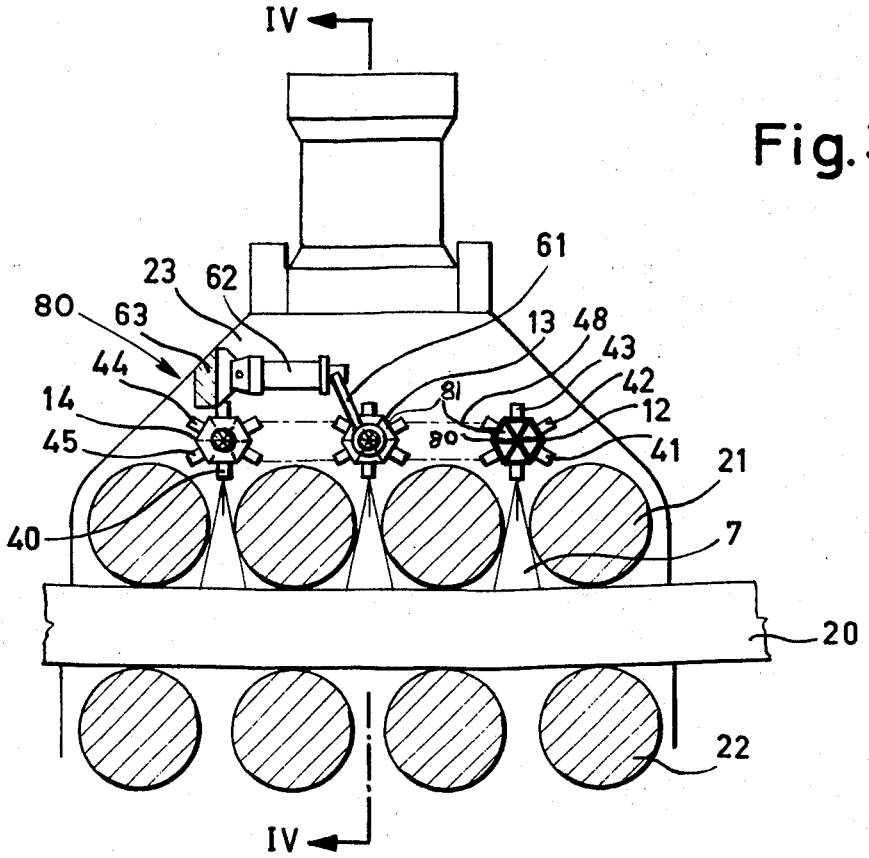
Fig. 3
Fig. 4
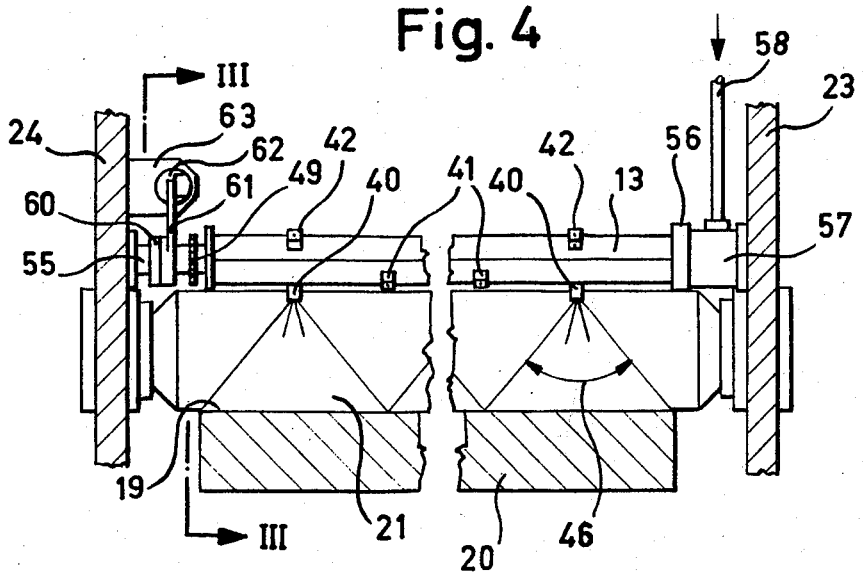

APPARATUS FOR THE DIRECT COOLING OF A STRAND

BACKGROUND OF THE INVENTION

The present invention relates to a new and improved construction of apparatus for the direct cooling of a strand, especially during the continuous casting of steel, and which apparatus is of the type embodying strand guide segments equipped with spray nozzles for the application of a cooling agent to the strand and devices for the infeed and adjustment of the quantity of such cooling agent.

According to a known apparatus for the cooling of a strand, fixed supports or holders in the form of nozzle blocks are located in the cooling zone, such nozzle blocks possessing a number of infeed lines or conduits for the cooling agent or coolant, typically water. The nozzles are connected in groups to the infeed lines, so that the cooling can be accommodated to the changing parameters, such as strand format or shape, quality of the steel, casting speed and so forth, by turning-on and turning-off selected groups of nozzles.

This state-of-the-art apparatus is quite expensive and complicated in its design owing to the prevailing piping or conduit arrangements. Shutting down of nozzles during the continuous casting operation is associated with the drawback of the clogging of the nozzle openings directed towards the hot strand, so that there occur irregularities in the cooling action. In order to avoid as far as possible such irregularities and disturbances there is required extensive maintenance work at the cooling zone, the accessibility to which is extremely difficult. If the accessibility is to be improved then it is necessary to dismantle the nozzle blocks, a job which is extremely time-consuming and results in longer downtimes of the installation. In order to be able to accommodate the cooling action to the changing parameters there is required in many instances a change in the pressure of the cooling agent. Since, upon changes in pressure, the spray angle and the spray characteristic of the individual nozzles only can be maintained constant within a small pressure change range, the actual cooling thus only corresponds to the prescribed values over a small range. In the case of continuous casting installations utilizing large changes in the strand format and strand speed the accommodation of the cooling of the strand to the changed conditions only can be realized with extremely great expenditure.

Upon changing the aforementioned parameters, the pressure changes and the therewith associated change in the quantity of water oftentimes is insufficient for accommodation to the cooling conditions. There are required nozzles with other rated water quantities. Such exchange and replacement of the nozzles is normally much too time-consuming with the prior art installations, so that there is only possible a limited change in the parameters.

SUMMARY OF THE INVENTION

Hence, it is a primary object of the present invention to provide a new and improved construction of apparatus for the direct cooling of a continuous cast strand in a manner not associated with the aforementioned drawbacks and limitations of the prior art proposals.

Another and more specific object of the invention aims at the provision of a new and improved construction of apparatus which enables cooling the strand in desired manner throughout the entire range of the change in the parameters, such as strand format, casting speed, steel quality or composition and so forth, and furthermore, wherein such apparatus is not readily subject to malfunction or breakdown and renders possible the inspection of the nozzles without any great expenditure in work or loss in time.

Now in order to implement these and still further objects of the invention which will become more readily apparent as the description proceeds, the invention contemplates that the nozzles are arranged at rotatable holders or supports, each holder being equipped with at least two nozzles, and there being provided a drive mechanism for the stepwise or incremental rotation of such holders and infeed means for the cooling agent delivered to the nozzles.

With this equipment it is possible to cool the strand without the need for any great expenditure or loss in time throughout the entire operating range of the installation without deviating from the prescribed values. The cooling can be accommodated without difficulty to the parameter changes. Even during the inspection and maintenance work there are not encountered any difficulties in controlling or checking the nozzles. By rotating the holders the nozzles can be brought into a position where they can be observed from the outside and inspected. Consequently, there is realized an improved utilization of the operating time of the installation and lower maintenance costs. Further the pipe conduits are reduced to a minimum.

Secured to the rotatable holders are spray nozzles possessing different throughflow quantities and different spray angles as well as spray characteristics. The nozzles are arranged in a star-like configuration about the rotational axis of the holder and can be brought into their spray position by rotating the holder. Only in this position is there delivered water to the nozzles. Since the nozzle openings which are located out of operation no longer confront the hot strand, the danger of closing or clogging of such nozzle openings is greatly minimized.

If, for instance, there should be cast with the same shape or format a steel which permits of an increased casting speed, that is to say, there is required of the nozzles a higher specific quantity of cooling water, then by rotating the holders nozzles are brought into spray position which possess a greater cooling water throughput with the same spray angle and same spray characteristic.

It is advantageous to construct the infeed means in the form of bores which connect the nozzles located in their spray position with a device for the infeed of the cooling agent.

Normally the cooling region is sub-divided into sections, and for the individual strand guide segments there can be applicable different prescribed or set values for the cooling. If in the individual segments there is employed a cooling system in which the entire strand width is always sprayed by a single nozzle, then an advantageous solution can be realized if each segment possesses at least one rotatable nozzle holder, the nozzle holder is equipped with nozzles which in each instance spray the entire strand width and only one of the nozzles of the holder is located in spray position.

If a system is employed in which a number of nozzles conjointy spray the entire strand width, then an advantageous solution can be realized if each strand guide segment possesses at least one rotatable nozzle holder, the nozzle holder is equipped with nozzles, at least two nozzles of the holder conjointy spray the entire strand width and at least two nozzles of the holder are located in spray position.

If a narrow format is cast, then, for instance two nozzles arranged transversely with respect to the strand are sufficient in order to spray the entire strand width. If at the same continuous casting installation there should be additionally cast considerably larger shapes or formats of the strand, then by rotating the holder it is possible to bring into the spray position nozzles with larger spray angle or additional nozzles and to connect the same with the water infeed. In every instance it is possible to adjust the cooling such that the prescribed cooling effect occurs at the strand.

Producing the rotational movements for the holder advantageously occurs in such a manner that for each strand guide segment a stepping drive drives one of the nozzle holders and this directly driven holder is operatively connected via a chain drive with the other nozzle holders of the same strand guide segment.

Of course, it is to be understood that instead of the chain drive there could be provided other devices for the transmission of the rotational movements. However, such must be able to withstand the harsh operating conditions which prevail at a continuous casting installation.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 3 is a partial sectional view substantially along the line III—III of FIG. 4 through a strand guide segment in the cooling region equipped with the inventive apparatus and wherein a number of nozzles are arranged adjacent one another transversely of the strand; and FIG. 4 is a partial sectional view taken substantially along the line Iv—IV of FIG. 3.

DETAILED DESCRIPTION OF THE PREFERRED EMBODIMENTS

Figure 1:
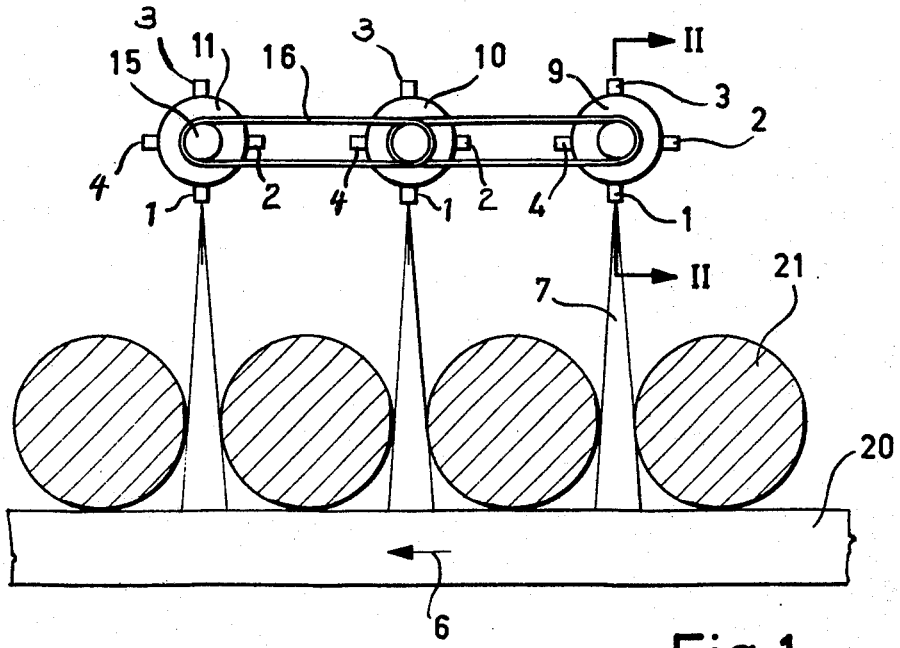
FIG. 1 is a simplified illustration of the inventive apparatus located in the cooling region of a continuous casting installation and wherein a single nozzle in each instance sprays the entire strand width.

Describing now the drawings it is to be first of all understood that only enough of the structure of a continuous casting installation has been illustrated therein in order to enable those skilled in the art to readily understand the underlying concepts of the development of this invention. Turning attention therefore specifically to FIGS. 1 and 2 there is shown therein the use of the inventive apparatus for an installation wherein the entire width of a continuously cast strand or casting 20 is impinged by a single spray pattern 7. Viewed in the direction of travel 6 of the strand 20 there follow a number of such spray patterns 7 which impinge the surface of the strand 20 with cooling water directed through the spaces between guide rollers 21 provided for the continuously cast strand. At the strand underside there are located correspondng rollers 22 which have not been portrayed in FIG. 1 but shown in the arrangement of FIG. 3, and such rollers 22 together with the rollers 21 are arranged in a strand guide segment, such as the segment 80 of FIG. 3, as will be discussed more fully hereinafter, but generally such arrangement being known to the art. Continuing, it will be observed by inspecting FIG. 1 that there are provided a number of nozzle holders or supports, such as the holders 9, 10 and 11. At each nozzle holder there are arranged at least two spray nozzles for the coolant, considered by way of example above to be constituted by water, and in the exemplary illustrated embodiment it will be recognized that at each holder there are provided the nozzles 1, 2, 3 and 4. The holders 9, 10 and 11 are each rotatable about an axle or shaft 8 defining an axis of rotation. The axes of the nozzles 1 to 4 extend approximately at right-angles to the associated axis of rotation 8 and mutually enclose an angle of 90° as best seen by reference to FIG. 1. In the position of the nozzle holders 9, 10 and 11 as shown in FIG. 1 cooling water is only delivered to the nozzles 1. If the format or shape of the strand 20 or its throughpassage speed is altered, then it is also necessary to change the quantity of water applied to the strand 20 or the shape of the spray pattern 7, which requires an accommodation of the surface of the strand impinged by the cooling water. This is achieved in that the nozzle holders 9, 10 and 11 are rotated to such an extent until those nozzles are located in the coolant spray position —sometimes simply referred to herein as the spray or spraying position— which deliver the desired quantity of water and exhibit the desired size of the impinged surface at the strand.

Figure 2:
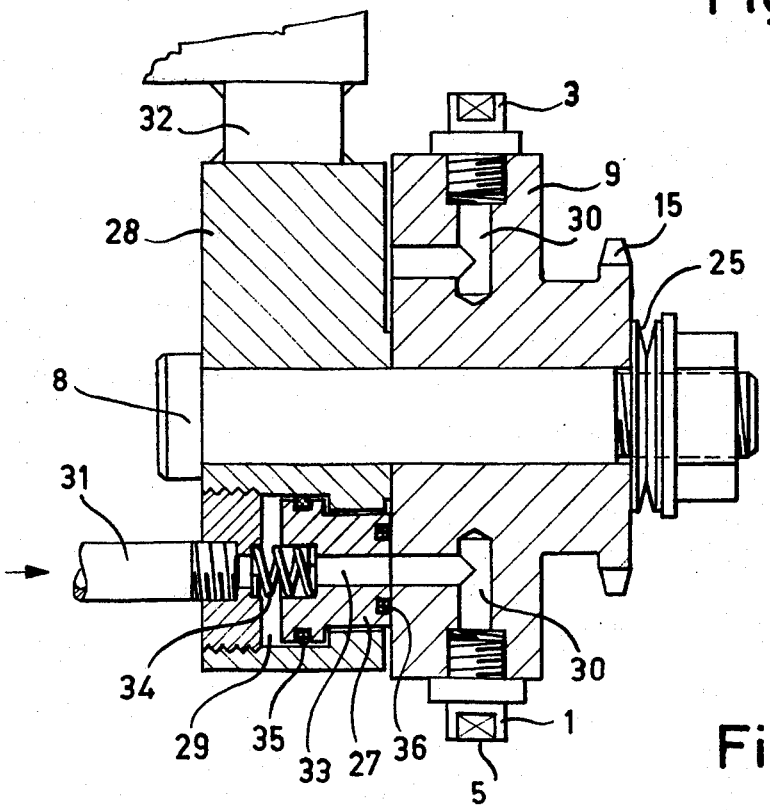
FIG. 2 is a cross-sectional view, taken substantially along the line II—II of FIG. 1.

In the case of the exemplary illustrated embodiment of FIGS. 1 and 2 there has been assumed by way of example and not limitation that four different strand formats or shapes are cast and wherein there is predetermined the casting speeds of such four formats. In order to be able to spray the four different widths of the strand 20 the spray patterns 7 of the nozzles 1 to 4 possess different spray angles. For instance, for a strand width of 1000 millimeters there is required a spray angle of 49°, for a strand width of 1500 millimeters a spray angle of 74°, for a strand width of 1700 millimeters a spray angle of 80°, and for a strand width of 2200 millimeters a spray angle of 90°. With these spray angles of the spray pattern 7 it is possible to spray the entire strand width with a single spray nozzle. The nozzle holders or supports 9, 10 and 11 collectively form a group which carry out synchronous movements through the agency of a chain drive 16 and sprocket wheels 15 by way of example. The drive mechanism or device for the chain drive, which acts upon the nozzle holder 9, will be described more fully hereinafter. One of the three nozzle holders 9, 10 and 11 is connected with a stepping drive which has not been shown to preserve clarity in illustration but will be discussed further in conjunction with the showing of the embodiment of FIGS. 3 and 4, this stepping drive in response to a control command rotating such holder through respective 90° increments of rotation. This movement is transmitted by the directly driven holder to both of the other holders via the chain drive arrangement 15, 16. The infeed of the cooling water as well as the nozzle holder 9 has been shown in detail in FIG. 2. The holder 9 is provided with bores 30. In each instance one bore or channel 30 is in flow communication with one of the nozzles 1 to 4. The sprocket wheel 15 is rigidly connected with the holder 9, this sprocket wheel serving for the transmission of the rotational movements to or from the other holders 10, 11 of the group. By means of springs 25 or equivalent structure the holder 9 is pressed against a connection block 28. This connection block 28 is mounted by means of an attachment member 32 at the frame of the here not particularly illustrated strand guide segment. In the connection block 28 there is provided a device 29 for the infeed of the cooling agent. This device or mechanism 29 is constituted by a main or primary infeed line 31 and a sealing body 27 provided with a bore 33. During the rotation of the holder 9 the sealing body 27 is pressed by means of a spring 34 against the holder 9 with the seal or seal element 36 of the sealing body contacting against such holder, as best seen by referring to FIG. 2. During the spraying operation the sealing body 27 provided with a further seal 35 is additionally pressed against the holder 9 due to the action of the water pressure. In the spray position the cooling water is accordingly delivered to the nozzle 1 through the agency of the water infeed device 29 and the bores 30. At the nozzle 1 there is delivered the cooling water through the nozzle opening 5 confronting the strand surface. By successively rotating the holder 9 through angular increments of 90° the nozzle 1 is rotated out of the spray position and one of the other nozzles 2, 3 or 4, as desired, is brought into the spray position. If the holder is only rotated through an angle of about 45°, then it is also possible to close the bore 33 in the sealing body or member 27 and therefore to place out of operation a part of the cooling of one cooling region section. This can be necessary, for instance, then when owing to some type of disturbance casting must occur at considerably reduced casting speed or the installation must be shutdown.

The axles or shafts 8 of the holders or supports 9, 10 and 11 in the showing of FIGS. 1 and 2 extend substantially parallel to the strand surface and at right-angles with respect to the strand direction of travel 6. The course of the shafts 8 is determined by the constructional aspects of the system. The shafts 8, by way of example, could extend in the same direction as the direction of travel 6 of the strand, i.e., the nozzle holders could be displaced through 90° with respect to the position shown in FIG. 1.

In the arrangement of FIGS. 3 and 4 there is shown a strand guide segment 80 as an exemplary embodiment of the apparatus wherein the strand surface is impinged with cooling water transversely with respect to the strand by a number of nozzles. Each such segment 80 may embody oppositely situated strand guide segment walls 23, 24 at which there are mounted the cooperating pairs of upper and lower rollers 21, 22 and the holders 12, 13, 14 carrying the spray nozzles 40, 41, 42, 43, 44, 45. While the strand guide segments can be employed for the most different types of strand guide assemblies, irrespective of the shape of the guide path, and may comprise four such cooperating pairs of rollers and three spray nozzle holders, obviously a lesser or greater number of such components can be utilized. The invention is in no way limited to the segment constructions disclosed herein by way of example. As the nozzle holders 12, 13 and 14 there are here employed hexagonal hollow profile members 80, the hollow spaces of which are each subdivided into six separate spaces or chambers 81 which are separated from one another, as will be recognized by referring to the nozzle holder 12 shown at the right-hand side of FIG. 3. Each side or face of each such multi-edge profile member 80 is equipped with one of the nozzles 40, 41, 42, 43, 44, 45 such that the strand surface impinged by the cooling water insures for the cooling of the strand 20 of a predetermined width and casting speed in an optimum manner. The holders or supports 12, 13 and 14 are connected with one another by means of a suitable drive, here again shown in the form of a chain drive 48 and sprocket wheels 49, by way of example. There is imparted to the intermediate nozzle holder 13 incremental rotational movements which in each instance amount to 60° by means of a switching or indexing lever 61 which is acted upon by a fluid-operated, such as pneumatic, control or indexing cylinder arrangement 62. These movements are transmitted via the chain drive 48 to the nozzle holders 12 and 14. The control or indexing cylinder or cylinder arrangement 62 is secured via a support 63 at the wall 24 of the strand guide segment 80 and which wall 24 is located at the left-hand side of FIG. 4. Between the indexing or switching lever 61 and the nozzle holder 13 there is arranged a free-wheeling coupling 60 and not particularly illustrated locking device or blocking gearing. The switching or indexing operation occurs such that initially the locking device is released, then the holder 13 is rotated through 60°, the locking device is again engaged, and the indexing lever 61 is again returned back into the starting position through the free-wheeling action of the coupling 60. The coupling 60 and the holder 13 are supported at the one side at the strand guide segment wall 24 by means of a bearing or support arrangement 55. At the other end of the holder 13 there is located a connection block 57 which is secured to the strand guide segment wall 23. At this side the holder 13 is mounted in a bearing or support arrangement 56 which is part of the connection block 57. At this point it is to be remarked that the connection block 57 in principle is constructed the same as the connection block 28 shown in FIG. 2. The water infeed in the connection block 57 insures that the cooling water will be delivered via the appropriate hollow space of the nozzle holder to those nozzles whose outlet openings confront the strand surface. The cooling water is delivered to the connection block 57 via a main or primary infeed line or conduit 58.

In the showing of FIG. 4 the nozzles 40 are located in the spray position. The spray angle 46 is chosen such that for a given spacing of the nozzle holders 12, 13 and 14 from the strand surface 19 the entire strand width is sprayed by means of three nozzles. In the illustrated example all three nozzles 4 at the nozzle holder 13 possess the same spray angle. Dependent upon the desired distribution of the cooling action over the surface 19 of the strand 20 it would be possible to also employ nozzles having different spray angles 46 and different specific water quantities.

If the nozzle holders 12, 13 and 14 are rotated through 60°, then, the nozzles 41 are located in the spray or spraying position. For each holder there are provided two nozzles 41 and such possess the same spray angle as the nozzles 40, however a different spray characteristic and a different specific quantity of water. When these nozzles 41 are located in the spray position, then a smaller strand format is cooled, which for the same quality normally is cast with a greater casting speed.

By rotating through further 60° increment the nozzles 42 now reach the spray position. With the nozzles 42 there can be cooled the same strand format as with the nozzles 40. However, in this case the throughput quantity of cooling water is greater, i.e. the nozzles 42 are placed into operation when casting a steel quality or composition which permits of a greater casting speed.

Also the nozzles 43, 44 and 45 are selected for other predetermined casting formats and casting speeds and arranged in appropriate numbers at the nozzle holders 12, 13 and 14. In addition to the possibility of adjusting the cooling by rotating the nozzle holders there is installed in the main infeed line or conduit 58 a quantity regulation valve of known construction. By means of this valve it is possible to undertake accommodations with respect to the quantity of cooling water within a range in which the spray characteristic and spray angle do not appreciably change with changes in the quantity of the cooling water. However, such valve is also provided for the purpose of being able to shut-off the delivery of the water when there occur interruptions in the operation of the installation, when there is necessary repair work or when other disturbances arise.

If in the course of the maintenance work there should be controlled, for instance, whether the nozzles 40 are mechanically in order or functioning, then the nozzle holders 12, 13 and 14 are rotated through 180°. Consequently, the nozzle outlet or exit openings become visible and can be inspected from the outside. If during such inspection of the nozzles there should not only be judged the mechanical conditions but rather also the spray pattern, then the connection block 57 is to be constructed such that water can likewise be delivered to the nozzles 40 in this position.

The switching or indexing operation of the stepping drive, in the illustrated example the pneumatic cylinder arrangement 62 shown in FIG. 3 —but equally useful in the arrangement of FIGS. 1 and 2— is triggered by actuation of valves. These valves can be magnetic valves of conventional design which receive suitable control signals via control lines or conductors. The control panel or desk can be located in the control room of the continuous casting plant or installation and possesses indicating devices which indicate which nozzles are located in the spraying position.

In the illustrated embodiments the nozzle holders are arranged in strand guide segments. The subject matter of the invention, however, can also be employed at installations without segment sub-division.

While there is shown and described present preferred embodiments of the invention, it is to be distinctly understood that the invention is not limited thereto, but may be otherwise variously embodied and practiced within the scope of the following claims. Accordingly

What is claimed is:

1. An apparatus for the direct cooling of a continuously cast strand, especially a steel strand in a secondary cooling zone of a continuous casting machine, comprising spray nozzles for applying a cooling agent to a continuously cast strand moving in a predetermined direction of travel, holders supporting said spray nozzles, infeed means delivering the cooling agent to the spray nozzles, means for rotatably mounting each of said holders about a given axis of rotation, each said axis of rotation of said holders being substantially parallel to the surface of the strand which is to be cooled, each of said holders being provided with at least two of said spray nozzles, drive means for the stepwise rotation of said holders in groups, said rotatably mounting means mounting each of said holders such that at least one spray nozzle of each holder assumes a cooling agent-spray position confronting the strand surface so that cooling agent emanating from each such confronting spray nozzle impinges the strand surface at approximately a right angle, each other spray nozzle which is not in said cooling-agent spray position confronting the strand surface, being disconnected from said infeed means, said drive means selectively positioning, by stepwise rotation of said holders in groups, given spray nozzles in said cooling agent-spray position as a function of the required amount of cooling agent per unit area of the strand surface to be cooled and the required width of the strand surface area to be cooled.

2. The apparatus as defined in claim 1, wherein said infeed means comprise bore means, a device for the delivery of the cooling agent, said bore means operatively connecting the nozzles located in their cooling agent-spray position with said device for the delivery of the cooling agent.

3. The apparatus as defined in claim 1, further including at least one segment, each segment possessing at least one of said rotatable nozzle holders, said at least one of said rotatable nozzle holders being equipped with said spray nozzles each of which is capable of assuming a said cooling agent-spray position confronting the strand surface for spraying the entire width of the continuously cast strand, and wherein only one of said nozzles of said nozzle holder is located in said cooling agent-spray position during spraying of the continuously cast strand with the cooling agent.

4. The apparatus as defined in claim 1 further including at least one segment, each segment possessing at least one of said rotatable nozzle holders, said at least one of said rotatable nozzle holders being equipped with nozzles capable of assuming said cooling agent-spray position confronting the strand surface, wherein at least two nozzles of such nozzle holder collectively spray the entire width of the continuously cast strand, and at least two nozzles of such nozzle holder being located in said cooling agent-spray position during spraying of the continuously cast strand with the cooling agent.

5. An apparatus for the direct cooling of a strand, especially during the continuous casting of steel, comprising spray nozzles for applying a cooling agent to a continuously cast strand moving in a predetermined direction of travel, holders supporting said spray nozzles, means rotatably mounting said holders, each holder being equipped with at least two of said spray nozzles, drive means connected to said holders for the stepwise rotation of said holders, and infeed means delivering cooling agent to the nozzles, at least one segment carrying said holders, said drive means including a stepping drive for each segment directly driving one of the nozzle holders and wherein said one directly driven nozzle holder is connected via a chain drive with the other nozzle holders of the segment.

* * * * *